US005372282A

United States Patent [19]

Barchus

[11] Patent Number: 5,372,282

[45] Date of Patent: Dec. 13, 1994

[54] INTERNALLY COUPLED AND STABILIZED DUAL ROLLER TUBE SQUEEZING DEVICE

[76] Inventor: David D. Barchus, 3673 Taft Ct., Wheat Ridge, Colo. 80033

[21] Appl. No.: 218,523

[22] Filed: Mar. 28, 1994

Related U.S. Application Data

[63] Continuation-in-part of Ser. No. 42,613, Apr. 2, 1993, Pat. No. 5,297,699.

[51] Int. Cl.[5] ..... B65D 35/28

[52] U.S. Cl. ..... 222/102

[58] Field of Search ..... 222/92, 95, 102; 251/6; 132/263

[56] References Cited

U.S. PATENT DOCUMENTS

| | | | |
|---|---|---|---|
| 1,773,104 | 8/1930 | Johnson | 222/102 |
| 1,983,462 | 12/1934 | Johnson | 222/102 |
| 3,938,474 | 2/1976 | Goings | 222/102 |
| 3,999,688 | 12/1976 | Hicks | 222/102 |
| 4,405,062 | 9/1983 | Tschida, Sr. | 222/102 |
| 4,639,251 | 1/1987 | Kirkland | 222/102 |
| 5,297,699 | 3/1994 | Barchus | 222/102 |

FOREIGN PATENT DOCUMENTS

| | | | |
|---|---|---|---|
| 446267 | 3/1949 | Italy | 222/102 |
| 444344 | 7/1949 | Italy | 222/102 |
| 452153 | 8/1949 | Italy | 222/102 |
| 464081 | 8/1951 | Italy | 222/102 |
| 91/09783 | 7/1991 | WIPO | 222/102 |

*Primary Examiner*—Andres Kashnikow

*Assistant Examiner*—Philippe Derakshani

*Attorney, Agent, or Firm*—John R. Flanagan

[57] ABSTRACT

A tube squeezing device includes a pair of hollow external rollers and a self-adjusting tension-applying support frame assembly rotatably supporting the external rollers and including a pair of internal stabilizer tubes which extend through the external rollers and a pair of self-adjusting end retainers having a pair of opposite end flanges adapted to abut against the opposite ends of the internal stabilizer tubes, a pair of elongated connector guide pins rigidly attached to opposite end flanges and extending axially therefrom to form tightly fitted connections within the opposite hollow ends of the internal stabilizer tubes, and a middle arcuate-shaped self-adjusting tensioner member extending between and rigidly connected at opposite ends to the opposite end flanges. Also, either the opposite ends of the stabilizer tubes or opposite end flanges of each end retainer have annular hubs formed thereon which fit within the respective opposite ends of the external rollers and provide bearing surfaces about and upon which the opposite ends of the external rollers ride and are rotatable relative to the support assembly. The arcuate-shaped tensioner members of the end retainers are sufficiently yieldably resilient to permit the end retainers to self-adjustably expand or contract to accommodate variation in the thickness of a flexible squeeze tube inserted between the external rollers and still urge the external rollers toward one another to apply a uniform squeezing force to opposite sides of the flexible squeeze tube.

20 Claims, 1 Drawing Sheet

INTERNALLY COUPLED AND STABILIZED DUAL ROLLER TUBE SQUEEZING DEVICE

CROSS-REFERENCE TO RELATED PATENT APPLICATION

This application is a continuation-in-part of copending U.S. patent application Ser. No. 08/042,613, filed Apr. 2, 1993, now U.S. Pat. No. 5,297,699.

BACKGROUND OF THE INVENTION

1. Field of the Invention

The present invention generally relates to a flexible tube squeezing device and, more particularly, is concerned with an internally coupled and stabilized dual roller flexible tube squeezing device.

2. Description of the Prior Art

It is a common problem for a user dispensing a fluid material, such as toothpaste, shampoo, adhesive, caulking, paints, etc., by manually squeezing a flexible tube, to have the contents of the tube spread throughout the tube. In particular, the contents spreads to the closed end of the tube as the user is attempting to dispense the contents from the open end.

The problem becomes greater as the tube becomes less full. Each time it is desired to dispense more of the fluid material, the user must first squeeze the tube starting at its closed end and working toward the open end in order to gather the contents at the open end.

It has been found desirable to provide assistance to the manual dispensing of the fluid material contained within the flexible tube in such a manner that precludes the contents from spreading to the closed end of the tube. The desired objective is to gather the contents towards the open end of the flexible tube, close off the emptied portion of the flexible tube, and thereby make each successive dispensing of a portion of the tube's contents as easy as the first.

A number of dual roller tube squeezing devices have been proposed in the prior patent art that attempt to provide this assistance to manual dispensing. Some representative examples of such tube squeezing devices are the ones disclosed in U.S. Pat. Nos. to Johnson (1,773,104 and 1,983,462), Hicks (3,999,688), and Kirkland (4,639,251), Italian patents to Bossi (444,344), Rubin (446,267 and 452,153) and Massai (464,081), and WIPO Intl. Publ. No. WO 91/09783. Many of these dual roller tube squeezing devices utilize pairs of cylindrical rollers which provide a slot between them into which the closed end of the flexible tube can be inserted. One of the dual roller tube squeezing devices disclosed in Italian Pat. No. 452,153 to Rubin utilizes a pair of rollers having internal solid nonelastic cores and elastic external coverings and a pair of flat tie rods pivotally interconnecting the rollers at their opposite ends by pins inserted through the opposite ends of the flat tie rods and into the centers of the opposite ends of the rollers.

However, a practical and effective technique to couple the rollers together is not provided in these disclosures. As a consequence, a need still exists for improvement in the design and construction of an internally coupled dual roller flexible tube squeezing device.

SUMMARY OF THE INVENTION

The invention of the copending application cross-referenced above, which is by the inventor of the present invention herein, provides a flexible tube squeezing device designed to satisfy the aforementioned need. The flexible tube squeezing device of the cross-referenced application employs a pair of rigid cylindrical rollers coupled together by an inelastic coupling strap. The coupling strap is provided in a looped configuration extending through longitudinal passages or bores in the rollers. The looped coupling strap maintains the rollers in alignment with one another. The coupling strap is sufficiently resilient to be capable of applying squeezing pressure via the rollers against the flexible tube when inserted between the rollers. The looped coupling strap used in the flexible tube squeezing device of the cross-referenced application provides a practical and effective way to couple the rollers together so as to achieve the desired squeezing action. However, some difficulty has been encountered in devising an automated system for mass production of the device wherein the opposite ends of the strap can mechanically manipulated and then secured together such that each looped strap of each device will apply the same amount of tension to the dual rollers.

The present invention provides a dual roller flexible tube squeezing device which employs a self-adjusting support frame assembly for applying a level of tension to the dual rollers which is substantially the same from device to device. The tension-applying support assembly is made up of components which can be more readily assembled together by an automated mass production system than the looped strap of the device in the cross-referenced application.

Accordingly, the present invention is directed to a flexible tube squeezing device which comprises: (a) a pair of elongated hollow external rollers, each external roller being made of substantially rigid material and defining an elongated interior bore extending between and open at a pair of opposite ends of the external roller; (b) a pair of elongated internal stabilizer tubes fitted internally through the external rollers, each internal stabilizer tube made of substantially rigid material and having a pair of opposite ends disposed adjacent to and within the opposite ends of one of the external rollers; and (c) a pair of end retainers each fitted to the adjacent ones of the opposite ends of the internal stabilizer tubes so as to produce therewith a generally rectangular support frame assembly having bearing surfaces defined at opposite ends thereof rotatably supporting the external rollers over the internal stabilizer tubes and confining the external rollers between the end retainers. At least portions of the end retainers being of a predetermined arcuate shape and fabricated of a yieldably resilient material permitting the end retainers to self-adjustably expand and contract to accommodate variation in thickness of a flexible tube inserted between the external rollers and still urge the external rollers toward one another so as to apply a substantially uniform squeezing forces to the opposite sides of the flexible tube.

Each internal stabilizer tube has a pair of opposite hollow ends and has an outside diameter sufficiently less than an inside diameter of each roller to leave an annular spaced therebetween. Each end retainer has a pair of opposite end flanges adapted to abut against the opposite ends of the internal stabilizer tubes, a pair of elongated connector guide pins each rigidly attached to one of the opposite end flanges and extending axially therefrom and forming a tight fitted connection within one of the opposite hollow ends of a respective internal stabilizer tube, and a middle arcuate-shaped self-adjusting tensioner member extending between and rigidly connected at opposite ends to the opposite end flanges.

Further, either the opposite ends of the internal tubes or the opposite end flanges of each end retainer have annular hubs formed thereon which fit within the bore of a respective one of the external rollers at one of the opposite ends thereof. Each of the hubs has an outside diameter slightly less than the inside diameter of the respective external roller so as to define the bearing surfaces on the support frame assembly at each of the opposite ends of the external rollers about and upon which the opposite ends of the external rollers ride and the external rollers are rotatable relative to the support frame assembly.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
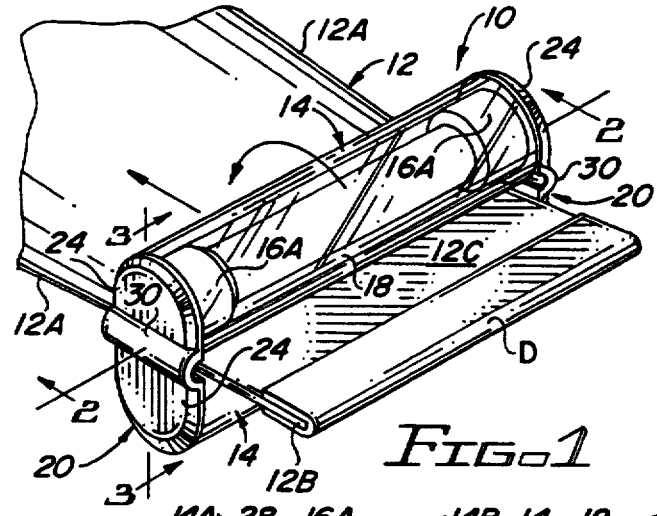
FIG. 1 is a perspective view of a tube squeezing device of the present invention shown applied over a flexible tube near its closed end.
Figure 3:
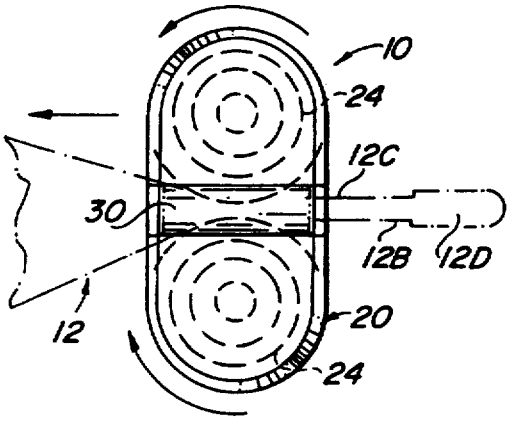
FIG. 3 is an enlarged end elevational view of the tube squeezing device taken along line 3—3 of FIG. 1.
Figure 2:
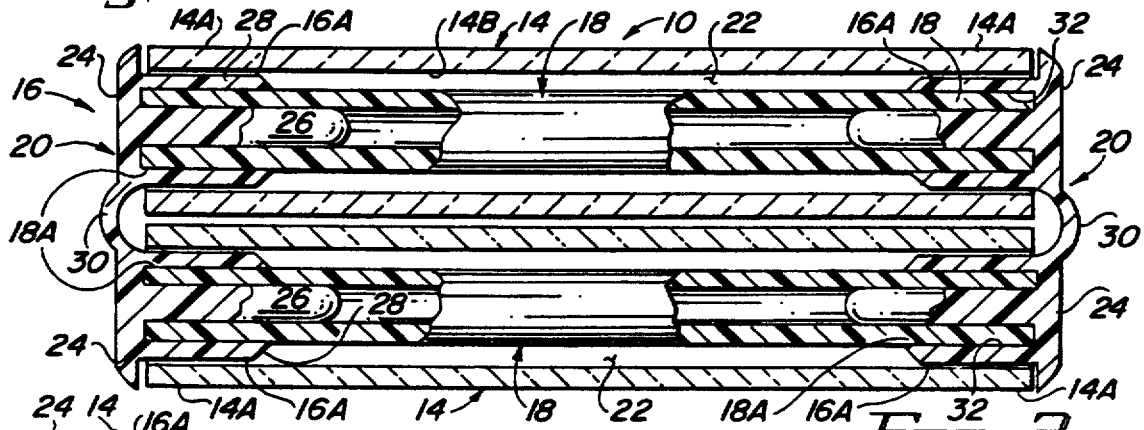
FIG. 2 is an enlarged longitudinal sectional view of the tube squeezing device taken along line 2—2 of FIG. 1.

Referring to the drawings and particularly to FIGS. 1 to 4, there is illustrated a dual roller flexible tube squeezing device of the present invention, being generally designated 10. A flexible squeeze tube 12 is shown with the tube squeezing device 10 inserted over opposite sides 12A of its rear closed end 12B. As the tube squeezing device 10 is moved over the flexible squeeze tube 12, it functions to force the contents of the tube 12 to flow toward a forward open end thereof closed by a cap (not shown) and, concurrently, to prevent the fluid contents from spreading back toward the closed end 12B thereof. Thus, the tube squeezing device 10 functions to effectively close off the emptied portion 12C of the flexible squeeze tube 12.

Referring still to FIGS. 1–4, the tube squeezing device 10 basically includes a pair of elongated hollow external rollers 14 and a support frame assembly 16 for rollably coupling the external rollers 14 together and applying tension to the external rollers 14 when the device 10 is inserted over the flexible squeeze tube 12 with the flexible squeeze tube 12 extends between the external rollers 14. Each of the external rollers 14 is made of a substantially rigid material, such as a suitable plastic, is of cylindrical configuration, and has a pair of opposite ends 14A and an elongated cylindrical interior bore 14B extending between and open at the opposite ends 14A of the respective external roller 14.

The tension-applying support frame assembly 16 includes a pair of elongated internal stabilizer tubes 18 (only one being shown in FIG. 4) and a pair of end retainers 20. The internal stabilizer tubes 18 are fitted internally through the bores 14B of the respective external rollers 14. Each internal stabilizer tube 18 is made of a substantially rigid material, such as a suitable plastic, and has a pair of opposite ends 18A disposed adjacent to and within the respective opposite ends 14A of the external rollers 14. The end retainers 20 are each fitted to the adjacent ones of the opposite ends 18A of the internal stabilizer tubes 18 so as to produce therewith the generally rectangular support frame assembly 16 having cylindrical bearing surfaces 16A defined at opposite ends thereof rotatably supporting the internal rollers 14 at opposite ends 14A thereof over the internal stabilizer tubes 18 and confining the external rollers 14 between the end retainers 20. As will be described below in greater detail, at least portions of the end retainers 20 are of a predetermined arcuate shape and fabricated of a yieldably resilient material permitting the end retainers 20 to self-adjustably expand and contract to accommodate variation in thickness of flexible squeeze tube 12 inserted between the external rollers 14 while still urging the external rollers 14 toward one another so as to apply a substantially uniform squeezing force to the opposite sides 12A of the flexible tube 12.

More particularly, each internal stabilizer tube 18 has a pair of opposite hollow ends 18A and is made of substantially rigid material. Also, each internal stabilizer tube 18 has an outside diameter sufficiently less than the inside diameter of each external roller 14 to define an annular space 22 therebetween.

Each end retainer 20 has a pair of opposite end flanges 24, a pair of elongated connector guide pins 26, a pair of annular hubs 28, and a middle arcuate-shaped tensioner member 30. Preferably, these parts of each end retainer 20 are injection molded in one piece. The opposite end flanges 24 are adapted to overlie the outer edges 18B on the opposite ends 18A of the internal stabilizer tubes 18. Each of the guide pins 26 is rigidly attached to one of the opposite end flanges 24 and extends axially outwardly therefrom in substantially perpendicular relation to the plane of the one end flange 24. Also, each guide pin 26 is interference fitted within one of the opposite hollow ends 18A of a respective internal stabilizer tube 18. Each of the annular hubs 28 is also rigidly attached to one of the opposite end flanges 24 and extends axially outwardly therefrom in substantially perpendicular relation to the plane of the one end flange 24.

Each annular hub 28 of the end retainer 20 is fitted within the bore 14 of one of the external rollers 14 at one of the opposite ends 14A thereof. Each annular hub 28 has an outside diameter slightly less than the inside diameter of the respective roller 14 so as to define each of the bearing surfaces 16A adjacent to and within the respective opposite ends 14A of the external rollers 14 about and upon which the opposite ends 14A of the external rollers 14 ride and are rotatable relative to the support frame assembly 16. The annular hubs 28 extend concentrically about and are spaced outwardly from the respective elongated guide pins 26 so as to define annular gaps 32 therebetween. The annular hubs 28 also have inside diameters slightly larger than the outside diameters of the opposite ends 18A of the internal stabilizer tubes 18 so as to fit over and make tight fitting connections with the opposite ends 18A of the internal stabilizer tubes 18 which are also received within the annular gaps 32 and fitted over the guide pins 26.

Lastly, the middle tensioner member 30 of each end retainer 20 extends between and is rigidly connected at its opposite ends to the opposite end flanges 24. The tensioner member 30 has a predetermined arcuate shape, such as being C-shaped in cross-section, and is fabricated of a suitable yieldably resilient material so as to permit the end retainer 20 to self-adjustably expand and contract, that is, the annular hubs 28 to move farther apart or closer together, in response to, and in order to accommodate, variation in thickness of different flexible squeeze tubes 12 which are inserted between the external rollers 14, while still urging the external rollers 14 toward one another so as to apply the substantially uniform squeezing force to the opposite sides 12A of the flexible squeeze tube 12.

Figure 5:
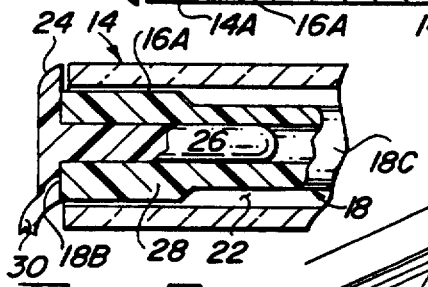
FIG. 5 is a fragmentary exploded perspective view of an alternative construction of the interfitting portions of each end retainer and internal stabilizer tube of the device.
Figure 4:
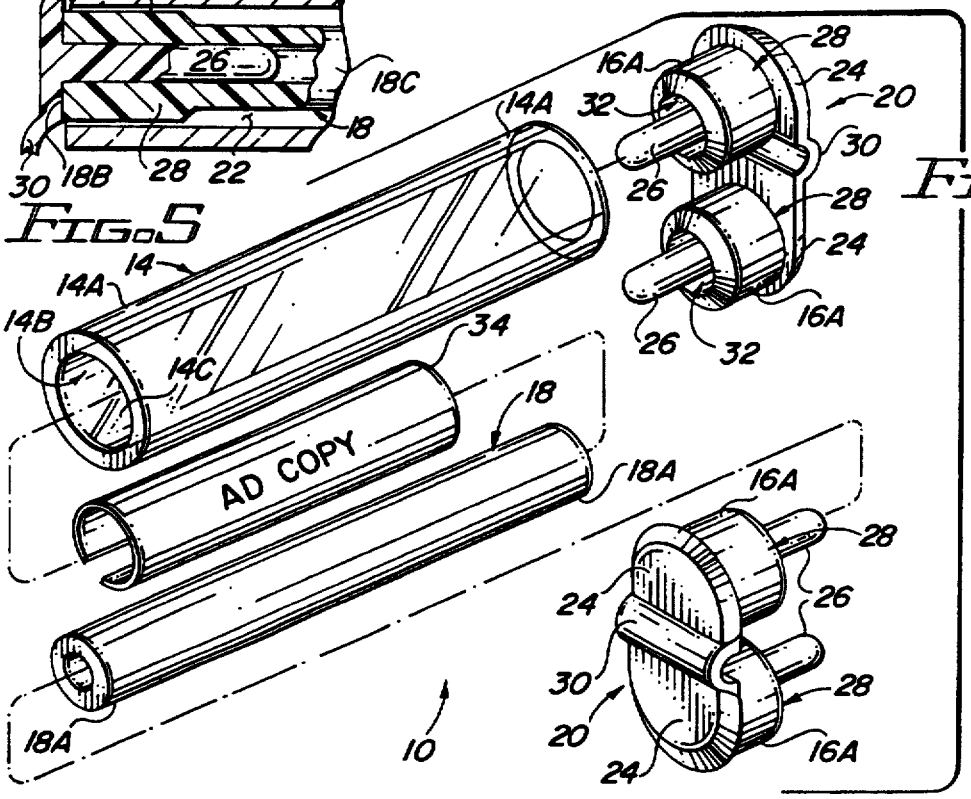
FIG. 4 is an exploded perspective view of the tube squeezing device of FIG. 2 showing a pair of end retainers but only one of a pair of internal stabilizer tubes of the device.

Referring to FIG. 5, there is illustrated a modified construction of the end retainers 20 and internal stabilizer tubes 18 in that the annular hubs 28 are now integrally formed on each of the opposite ends 18A of the stabilizer tube 18 and only the guide pins 26 are provided on the end retainers 20. When the annular hubs 28 are thusly formed on the opposite ends 18A of the internal stabilizer tubes 18, the tubes 18 then have larger outside diameters at their opposite hub-forming ends 18A than the remaining longitudinal portions 18C of the tubes 18 extending between the end hubs 28.

Preferably, at least one of the end retainers 20 is held solely by friction to the opposite ends 18A of the internal stabilizer tubes 18 so that the one end retainer 20 can be pulled off and removed by a user to open the one end of the device 10 and allow the user to more easily slide the dual external rollers 14 of the device 10 onto and across the flexible squeeze tube 12 in front of a thickened seam or rib 12D which may be present at the rear end 12B of some types of flexible squeeze tubes 12. It should be realized that the other end retainer 20 can be molded rigidly with the internal stabilizer tubes 18.

Referring again to FIG. 4, the tube squeezing device 10 also preferably include a label 34, preferably in a rolled form, being inserted in the interior bore 14B of at least one and preferably both of the external rollers 14 and captured in the annular space 22 between the external roller 14 and internal stabilizer tube 18. When rolled labels 34 are to be employed with the external rollers 14, the external rollers 14 would then be made of transparent material so that the indicia, such as advertising copy, imprinted on outer or exterior sides of the labels 34 can be easily read from the exterior of the external rollers 14. The rolled labels 32 hug the cylindrical interior surfaces 14C of the respective external rollers 14 and the respective longitudinal portions 18C of the internal stabilizer tubes 18 extending through the internal bore 14B of the given roller 14 also extend through the respective rolled label 34. Preferably, the rolled labels 34 are shorter than the respective external rollers 14 so as to terminate inwardly at about ¼ inch from the opposite ends of the external rollers 14 and thereby provide clearance between the label 34 and the annular hubs 28 of the end retainers 20 or internal stabilizer tubes 18 so that the label will not interfere with assembly of the end retainers 20 to the opposite ends 18A of the internal stabilizer tubes 18. It should also be realized that the advertising copy can be applied directly on the internal stabilizer tubes 18.

In operation, when the tube squeezing device 10 is inserted over the closed end 12B of the flexible tube 12, each time the fluid material is dispensed from the tube 12 the tube squeezing device 10 is be manually rolled toward the open dispensing end (not shown) of the tube 12 to gather and maintain the dispensing end of the tube 12 filled with the fluid material. The yieldable resiliency of the self-adjusting middle tensioner members 30 of the end retainers 20 causes a braking action which holds the external rollers 14 at whatever position where they are stopped along the flexible squeeze tube 12.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A flexible tube squeezing device, comprising:

(a) a pair of elongated hollow external rollers, each external roller being made of substantially rigid material and having an elongated interior bore extending between and open at a pair of opposite ends of said roller;

(b) a pair of elongated internal stabilizer tubes fitted internally through said external rollers, each internal stabilizer tube made of substantially rigid material and having a pair of opposite ends disposed adjacent to and within said opposite ends of one of said external rollers; and (c) a pair of end retainers each fitted to the adjacent ones of said opposite ends of said internal tubes so as to produce therewith a generally rectangular support frame assembly having bearing surfaces defined at opposite ends thereof rotatably supporting said external rollers over said internal tubes and confining said external rollers between said end retainers, at least portions of said end retainers being of a predetermined arcuate shape and fabricated of a yieldably resilient material permitting said end retainers to self-adjustably expand and contract to accommodate variation in thickness of a flexible squeeze tube inserted between said external rollers and still urge said external rollers toward one another so as to apply a substantially uniform squeezing force to the opposite sides of the flexible squeeze tube.

2. The device of claim 1 wherein each of said internal stabilizer tubes has an outside diameter sufficiently less than an inside diameter of each of said external rollers to define an annular space therebetween.

3. The device of claim 2 further comprising:

a label in a rolled form inserted in said annular space between at least one of said external rollers and said internal stabilizer tube therein.

4. The device of claim 1 wherein each end retainer includes a pair of opposite end flanges adapted to overlie respective outer edges of opposite ends of said internal stabilizer tubes.

5. The device of claim 4 wherein each end retainer also includes a pair of elongated connector guide pins each rigidly attached to one of said opposite end flanges and extending axially therefrom and fitted within one of said opposite ends of a respective one of said internal stabilizer tubes.

6. The device of claim 5 wherein each end retainer further includes a middle tensioner member extending between and rigidly connected at opposite ends to said opposite end flanges, said tensioner member being said portion of said end retainer having said predetermined arcuate shape and being fabricated of said yieldably resilient material permitting said end retainer to self-adjustably expand and contract.

7. The device of claim 4 wherein either said opposite ends of said internal stabilizer tubes or said opposite flanges of said end retainers have annular hubs formed thereon and fitted within said bores of said external rollers at said opposite ends thereof, said hubs defining said bearing surfaces at said opposite ends of said support frame assembly.

8. The device of claim 1 wherein at least one of the end retainers is held by friction to said adjacent ends of said opposite ends of said internal stabilizer tubes so that said one end retainer can be pulled off and removed by a user to open one end of said support frame assembly and allow the user to slide said external rollers over opposite sides of the flexible squeeze tube.

9. A flexible tube squeezing device, comprising:

(a) a pair of elongated hollow external rollers, each of said external rollers being made of substantially rigid material and having an elongated interior bore extending between and open at a pair of opposite ends of said external roller;

(b) a pair of elongated internal stabilizer tubes fitted internally through said external rollers, each internal stabilizer tube made of substantially rigid material and having a pair of opposite ends disposed adjacent to and within said opposite ends of one of said external rollers; and (c) a pair of end retainers each fitted to the adjacent ones of said opposite ends of said internal stabilizer tubes so as to produce therewith a generally rectangular support frame assembly having bearing surfaces defined at opposite ends thereof rotatably supporting said external rollers over said internal stabilizer tubes and confining said external rollers between said end retainers, each end retaininer including (i) a pair of opposite end flanges adapted to overlie respective outer edges of said opposite ends of said internal stabilizer tubes, (ii) a pair of elongated connector guide pins each rigidly attached to one of said opposite end flanges and extending axially therefrom and fitted within one of said opposite ends of a respective one of said internal stabilizer tubes, (iii) a pair of annular hubs rigidly attached to said respective opposite end flanges and extending axially therefrom and fitted within said bores of said external rollers at said adjacent ones of said opposite ends thereof, said hubs defining said bearing surfaces at said opposite ends of said support frame assembly, said hubs extending concentrically about said respective elongated guide pins so as to define annular gap therebetween receiving therein adjacent ones of said opposite ends of said internal stabilizer tubes being fitted over said elongated guide pins, and (iv) a middle tensioner member extending between and rigidly connected at opposite ends to said opposite end flanges, said tensioner member having a predetermined arcuate shape and being fabricated of a yieldably resilient material so as to permit said end retainer to self-adjustably expand and contract to accommodate variation in thickness of a flexible squeeze tube inserted between said external rollers and still urge said external rollers toward one another so as to apply a substantially uniform squeezing force to the opposite sides of the flexible squeeze tube.

10. The device of claim 9 wherein each of said annular hubs of said end retainers has an inside diameter slightly larger than the outside diameter of a respective one of said internal stabilizer tubes so as to fit over a respective one of said opposite ends of said internal stabilizer tube and make a tight fitting connection therewith.

11. The device of claim 9 wherein each of said annular hubs has an outside diameter slightly less than an inside diameter of a respective one of said external roller so as to define said bearing surface at each of said opposite ends of said external roller about and upon which said opposite ends of said external roller ride and said external roller is rotatable relative to said support frame assembly.

12. The device of claim 9 wherein each of said internal stabilizer tubes has an outside diameter sufficiently less than an inside diameter of each of said external rollers so as to define an annular space therebetween.

13. The device of claim 12 further comprising:

a label in a rolled form inserted in said annular space between at least one of said external rollers and said internal stabilizer tube therein.

14. The device of claim 9 wherein at least one of the end retainers is held by friction to said adjacent ends of said opposite ends of said internal stabilizer tubes such that said one end retainer can be pulled off and removed by a user to open one end of said support frame assembly and allow the user to slide said external rollers over opposite sides of the flexible squeeze tube.

15. A flexible tube squeezing device, comprising:

(a) a pair of elongated hollow external rollers, each of said external rollers being made of substantially rigid material and having an elongated interior bore extending between and open at a pair of opposite ends of said external roller;

(b) a pair of elongated internal stabilizer tubes fitted internally through said external rollers, each internal stabilizer tube made of substantially rigid material and having a pair of opposite ends disposed adjacent to and within said opposite ends of one of said external rollers, each of said internal stabilizer tubes having a pair of annular hubs formed about said opposite ends thereof being disposed within said bores of said external rollers at said adjacent ones of said opposite ends thereof and defining bearing surfaces at said opposite hub-forming ends about and upon which said opposite ends of said external roller ride and said external roller is rotatable relative thereto; and (c) a pair of end retainers each fitted to the adjacent ones of said opposite ends of said internal stabilizer tubes so as to produce therewith a generally rectangular support frame assembly having said bearing surfaces defined at opposite ends thereof rotatably supporting said external rollers over said internal stabilizer tubes and confining said external rollers between said end retainers, each end retaininer including (i) a pair of opposite end flanges adapted to overlie respective outer edges of said opposite ends of said internal stabilizer tubes, (ii) a pair of elongated connector guide pins each rigidly attached to one of said opposite end flanges and extending axially therefrom and fitted within one of said opposite ends of a respective one of said internal stabilizer tubes, and (iii) a middle tensioner member extending between and rigidly connected at opposite ends to said opposite end flanges, said tensioner member having a predetermined arcuate shape and being fabricated of a yieldably resilient material so as to permit said end retainer to self-adjustably expand and contract to accommodate variation in thickness of a flexible squeeze tube inserted between said external rollers and still urge said external rollers toward one another so as to apply a substantially uniform squeezing force to the opposite sides of the flexible squeeze tube.

16. The device of claim 15 wherein each of said opposite hub-forming ends of said internal stabilizer tubes has an inside diameter slightly larger than the outside diameter of a respective one of said elongated guide pins so as to fit thereover and make a tight fitting connection therewith.

17. The device of claim 15 wherein each of said annular hubs has an outside diameter slightly less than an inside diameter of a respective one of said external roller so as to define said bearing surface at each of said opposite ends of said external roller.

18. The device of claim 15 wherein each of said internal stabilizer tubes includes an elongated longitudinal portion extending between said opposite hub-forming ends and having an outside diameter sufficiently less than an inside diameter of each of said external rollers so as to define an annular space therebetween.

19. The device of claim 18 further comprising:

a label in a rolled form inserted in said annular space between at least one of said external rollers and said internal stabilizer tube therein.

20. The device of claim 15 wherein at least one of the end retainers is held by friction to said adjacent ends of said opposite ends of said internal stabilizer tubes such that said one end retainer can be pulled off and removed by a user to open one end of said support frame assembly and allow the user to slide said external rollers over opposite sides of the flexible squeeze tube.

* * * * *